US008543047B2

(12) United States Patent
Hosoi et al.

(10) Patent No.: US 8,543,047 B2
(45) Date of Patent: Sep. 24, 2013

(54) IMAGE FORMING SYSTEM

(75) Inventors: Shinichiro Hosoi, Tokyo (JP); Youichi Chikugo, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 138 days.

(21) Appl. No.: 13/137,594

(22) Filed: Aug. 29, 2011

(65) Prior Publication Data

US 2012/0051811 A1 Mar. 1, 2012

(30) Foreign Application Priority Data

Aug. 31, 2010 (JP) ..... 2010-195194

(51) Int. Cl.
*G03G 15/20* (2006.01)

(52) U.S. Cl.
USPC ..... 399/341

(58) Field of Classification Search
USPC ..... 399/67, 68, 341, 342
See application file for complete search history.

(56) References Cited

U.S. PATENT DOCUMENTS 7,983,581 B2 * 7/2011 Ishigami et al. ..... 399/69

FOREIGN PATENT DOCUMENTS

JP 2000-221821 8/2000
JP 2007-328023 12/2007

* cited by examiner

*Primary Examiner* — Hoang Ngo
(74) *Attorney, Agent, or Firm* — Fitzpatrick, Cella, Harper & Scinto

(57) ABSTRACT

An image forming system includes a color image forming apparatus including: a color image forming portion for forming a color toner image on a surface of a recording material; a first fixing device including a first fixing portion; a second fixing device including a second fixing portion; image forming and a third fixing device for fixing a transparent toner image at a third fixing portion; and a controller for controlling a switching mechanism so that the conveyance direction of the recording material is switched to the bypass direction of the second fixing portion, or to the direction toward the second fixing portion based on whether or not the color image forming portion is subjectd to formation of the transparent toner image by the transparent image forming apparatus.

3 Claims, 4 Drawing Sheets

IMAGE FORMING SYSTEM

FIELD OF THE INVENTION AND RELATED ART

The present invention relates to an image forming system including a color image forming apparatus for forming and fixing a color toner image on a recording material and including a transparent image forming apparatus for forming and fixing a transparent toner image on the recording material on which the color toner image is fixed by the color image forming apparatus.

In recent years, there is an increasing demand for an image quality improvement of the image forming apparatus. For example, Japanese Laid-Open Patent Application (JP-A) 2007-328023 proposes an image forming system in which the color image forming apparatus and the transparent image forming apparatus are adjacently connected and a high-quality photograph-like image is outputted on the recording material and thereon a transparent image is formed with a transparent toner (clear toner) which becomes transparent after fixing.

Further, with respect to the color image forming apparatus, JP-A 2000-221821 proposes that a fixing device including a plurality of fixing device portions is used to output a high gloss image.

However, in the image forming system in which the color image forming apparatus using the plurality of fixing device portions described above and the transparent image forming apparatus are adjacently connected, it was found that the following problem occurred.

That is, e.g., in the case where the transparent image is formed on both sides (both surfaces) of the recording material, each of the surfaces of the recording material passes through the fixing device plural times. For that reason, an excessive heat quantity is applied to the recording material, so that an inconvenience such as hot offset or improper separation can be caused.

The hot offset is a phenomenon that the toner is deposited on the surface of the fixing member in the case where a temperature of the fixing member such as a fixing roller or a fixing belt (film), so that first contamination can occur with one lap behind. Further, the improper separation is a phenomenon that a depositing force of the toner, on the recording material, onto the surface of the fixing member is increased and thus it becomes difficult to separate the recording material from the fixing member, so that improper conveyance of the recording material, such as jamming of the recording material in the fixing device can occur.

SUMMARY OF THE INVENTION

A principal object of the present invention is to provide an image forming system, including a color image forming apparatus and a transparent image forming apparatus, capable of suppressing an occurrence of inconveniences such as hot offset and improper separation resulting from an increase in the number of times a recording material passes through a fixing device.

According to an aspect of the present invention, there is provided an image forming system comprising:

a color image forming apparatus including: a color image forming portion for forming a color toner image on a surface of a recording material; a first fixing device including a first fixing member for fixing the color toner image on the surface of the recording material by heating, at a first fixing portion, the surface of the recording material on which the color toner image is formed immediately before by the color image forming portion; a second fixing device including a second fixing member for heating, at a second fixing portion, the surface of the recording material heated immediately before by the first fixing member; and a switching mechanism for switching a conveyance direction of the recording material passing through the first fixing portion to a direction toward the second fixing portion and to a bypass direction of the second fixing portion;

a transparent image forming apparatus including: a transparent image forming portion capable of forming a transparent toner image on the surface of the recording material on which the color toner image is fixed by the color image forming apparatus; and a third fixing device including a third fixing member for fixing the transparent toner image on the surface of the recording material by heating, at a third fixing portion, the surface of the recording material on which the transparent toner image is formed immediately before by the transparent image forming portion; and a controller for controlling the switching mechanism so that the conveyance direction of the recording material is, when the surface of the recording material on which the color toner image is formed immediately before by the color image forming portion is to be subjected to formation of the transparent toner image by the transparent image forming apparatus, switched to the bypass direction of the second fixing portion and so that the conveyance direction of the recording material is, when the surface of the recording material on which the color, toner image is formed immediately before by the color image forming portion is to be not subjected to formation of the transparent toner image by the transparent image forming apparatus, switched to the direction toward the second fixing portion.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Embodiment 1

1. General Structure and Operation of Image Forming Apparatus

Figure 1:
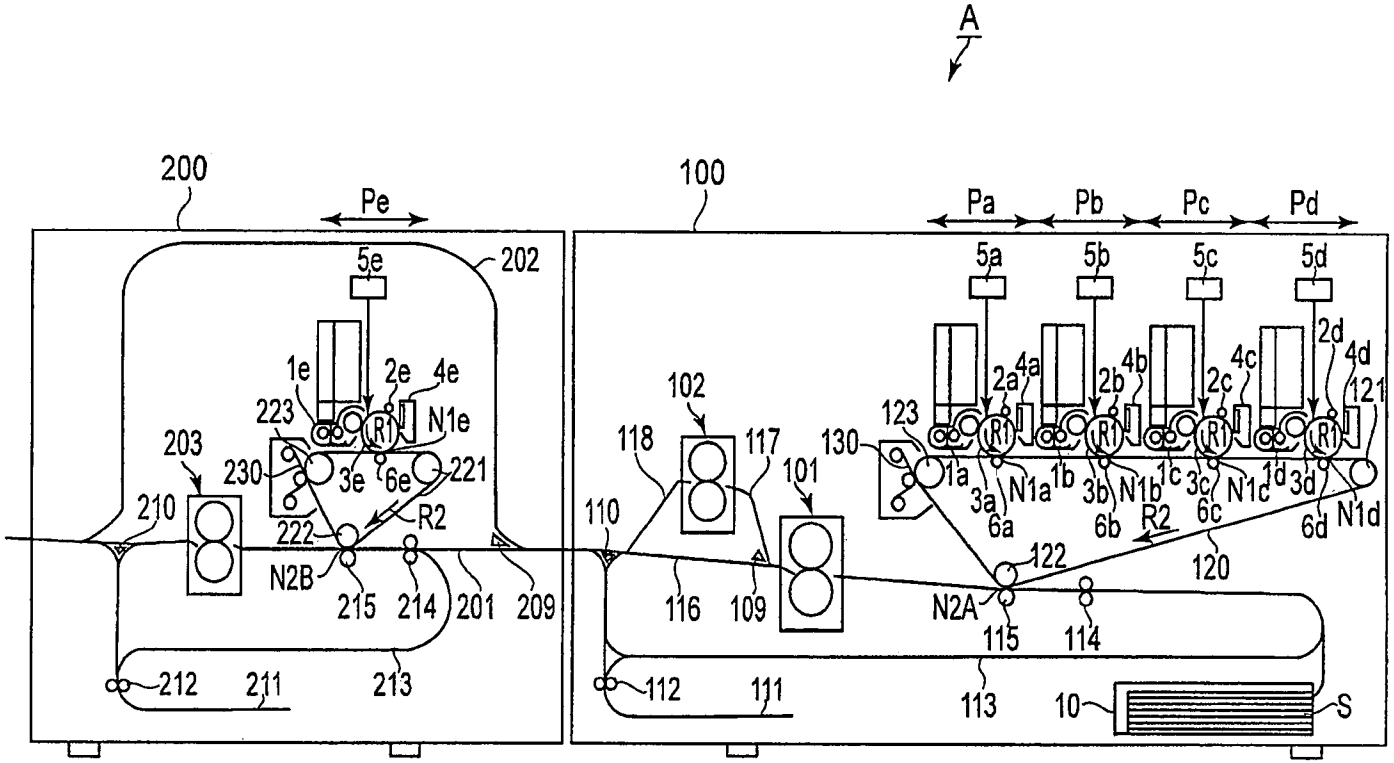
FIG. 1 is a schematic sectional view of an image forming system according to an embodiment of the present invention.

First, a general structure and operation of an image forming system in this embodiment will be described. FIG. 1 is a schematic sectional view for illustrating a structure of an image forming system A in this embodiment. The image forming system A in this embodiment includes a color image forming apparatus 100 and a transparent image forming apparatus 200 connected, as a subsequent stage, to the color image forming apparatus 100.

1-1. Color Image Forming Apparatus

The color image forming apparatus 100 employs an electrophotographic type, a tandem type and an intermediary transfer type and is capable of forming a color image such as full-clear image or mono-clear image with a clear toner.

Inside of the clear image forming apparatus 100, first to fourth image forming portions Pa, Pb, Pc and Pd are successively disposed. In the respective first to fourth image forming portions Pa to Pd, toner images are formed with different types of toners by an electrophotographic image forming process.

Incidentally, in this embodiment, constitutions and operations of the respective image forming portions. Pa to Pd are substantially identical to each other except that the types of the toners used are different from each other. Therefore, in the case where there is no need to particularly discriminate the image forming portions and their constituent elements, suffixes a, b, c and d added to represent the elements for the respective image forming portions will be omitted from the following description and will be collectively described.

The image forming portion P includes a drum-like electrophotographic photosensitive member as a first image bearing member on which a toner image to be formed, i.e., a photosensitive drum 3. On each photosensitive drum 3, the toner image is formed. Adjacently to each photosensitive drum 3, an intermediary transfer member 120 as a second image bearing member onto which the toner image is to be transferred from the first image bearing member is provided. The toner image formed on each photosensitive drum 3 is primary-transferred onto the intermediary transfer member 120 at each primary transfer portion N1 and then is secondary-transferred onto the recording material S at each secondary transfer portion (for color image) N2A. The recording material S on which the toner image is transferred is heated and pressed by a first fixing device 101 or by the first fixing device 101 and a second fixing device 102, so that the toner image is fixed on the recording material S and then is discharged from the color image forming apparatus 100 to be conveyed to the transparent image forming apparatus 200.

The photosensitive drum 3 is rotationally driven in an arrow R1 direction in FIG. 1. At the image forming portion P, around the photosensitive drum 3, the following means are provided. First, a charging roller 2 as a charging means is provided. Next, a developing device 1 as a developing means is provided. Next, a transfer roller 6 as a primary transfer means is provided. Next, a cleaner 4 as a cleaning means is provided. Further, at the image forming portion P, above the photosensitive drum 3 in FIG. 1, a laser scanner 5 as an exposure means is provided.

In the laser scanner 5, a light source device, a polygon mirror and the like are provided. The laser scanner 5 scans the surface of the photosensitive drum 3 with laser light emitted from the light source device while rotating the polygon mirror and defects light flux of the laser (scanning) light by a reflection mirror and then focuses the light flux on a generating line of the photosensitive drum 3 through fθ lens, thus effecting light exposure. As a result, an electrostatic latent image (electrostatic image) depending on an image signal is formed on the photosensitive drum 3.

In the developing devices 1*a*, 1*b*, 1*c* and 1*d*, as a developer, a cyan toner, a magenta toner, a yellow toner and a black toner are filled, respectively, in a predetermined amount. The developing devices 1*a* to 1*d* develop the electrostatic latent images on the photosensitive drums 3*a* to 3*d*, respectively, to form a cyan image, a magenta image, a yellow image and a black image. To each developing device 1, a toner is timely supplied by a supplying device.

The intermediary transfer member 120 is formed with an endless belt (intermediary transfer belt) and is extended around a tension roller 121, a secondary transfer opposite roller 122 and a driving roller 123. The intermediary transfer member 120 is rotationally driven in an arrow R2 direction in FIG. 1 at the same peripheral speed as that of the photosensitive drum 3.

At an inner peripheral surface of the intermediary transfer member 120, the primary transfer roller 6 is disposed opposed to the associated photosensitive drum 3. Each primary transfer roller 6 is urged toward the associated photosensitive drum 3 to form the primary transfer portion (primary transfer nip) N1 where the photosensitive drum 3 contacts the intermediary transfer member 120. Further, at an outer peripheral surface of the intermediary transfer member 20, a secondary transfer roller 11 as a secondary transfer means is disposed opposed to the secondary transfer opposite roller 122. The secondary transfer roller 11 is urged toward the secondary transfer opposite roller 122 to form a secondary transfer portion for color image (secondary transfer nip for color image) N2A where the intermediary transfer member 20 contacts the secondary transfer roller 115. The secondary transfer roller 115 is shaft-supported substantially in parallel to the intermediary transfer member 120 and is provided in contact with the outer peripheral surface of the intermediary transfer member 120.

The toner image formed on the photosensitive drum 3 is primary-transferred onto the outer peripheral surface of the intermediary transfer member 120 in a process in which the toner image passes through the primary transfer portion N1. At this time, to the primary transfer roller 6, from a primary transfer power source as a voltage applying means, a primary transfer bias which is a DC voltage of an opposite polarity to a normal charge polarity of the toner is applied. The toner image on the photosensitive drum 3 is primary-transferred onto the intermediary transfer member 120 by an electric field formed in the primary transfer portion N1 by the primary transfer bias and pressure exerted between the photosensitive drum 3 and the intermediary transfer member 120.

The toner image transferred on the intermediary transfer member 120 is secondary-transferred onto the recording material S in a process in which the toner image passes through the color image secondary transfer portion N2A. At this time, from a secondary transfer power source as the voltage applying means, a secondary transfer bias which is a DC voltage of the opposite polarity to the normal charge polarity of the toner is applied. The toner image on the intermediary transfer member 120 is secondary-transferred onto the recording material S by an electric field formed in the color image secondary transfer portion N2A by the secondary transfer bias and pressure exerted between the intermediary transfer member 120 and the recording material S.

The recording material S is fed from a recording material cassette 10 and passes through a registration roller 114 and a pre-transfer guide and then is sent to the color image secondary transfer portion N2A with predetermined timing. In synchronism with this timing, the secondary transfer bias is applied to the secondary transfer roller 115.

The toner (primary transfer residual toner) remaining on the photosensitive drum 3 after the primary transfer is ended is removed and collected by the cleaner 4. The cleaned photosensitive drum 3 is subjected to subsequent formation of the electrostatic latent image. Further, the toner (secondary transfer residual toner) and other foreign matter which remain on the intermediary transfer member 120 after the secondary transfer is ended are wiped with a cleaning web (nonwoven fabric) 130 by bringing the cleaning web into contact with the surface of the intermediary transfer member 120.

In this embodiment, the color image forming means is constituted by the first to fourth image forming portions Pa to Pd, the intermediary transfer member 120, the secondary transfer roller 115 and the like. Further, the color image secondary transfer portion N2A constitutes a portion where the color toner image is formed on the recording material S by the color image forming means.

The recording material S on which the toner image is transferred is introduced into the first fixing device 101. The toner image is fixed on the recording material S by applying heat and pressure to the recording material S by the first fixing device 101. Specifically, as described later, the recording material S coming out of the first fixing device 101 is introduced into the second fixing device 102 or a first after-fixing path 116. In the case where the recording material S is introduced into the second fixing device 102, the recording material S is further heated and pressed, so that the toner image is further firmly fixed on the recording material S or a surface smoothness of the recording material S is improved to enhance glossiness.

The first after-fixing path 116 is the conveyance path through which the recording material S passes in the case where the recording material S passes through the first fixing portion 101 but does not pass through the second fixing device 102. From the first fixing device 101 to the second fixing device 102, the recording material S is conveyed through a second after-fixing path 117. Switching of the conveyance path of the recording material S between the direction toward the first after-fixing path 116 and the direction toward the second after-fixing path 117 is made by a first, flapper 109 as a switching means. That is, the first flapper 109 is the switching means for switching the conveyance direction of the recording material S passing through the fixing portion N3 of the first fixing device 101 to the direction toward the fixing portion N3 of the second fixing device 102 and a bypass direction of the fixing portion N3 of the second fixing device 102. Further, the recording material S coming out of the second fixing device 102 is conveyed through a third after-fixing path 118.

For example, during full-color image formation, the cyan toner image, the magenta toner image, the yellow toner image and the black toner image formed on the photosensitive drums 3 of the first to fourth image forming portions Pa to Pd are successively primary-transferred onto the intermediary transfer member 120 at the primary transfer portions N1. As a result, the synthetic toner images corresponding to an objective image are formed by superposition transfer of the toner images of the four types. Incidentally, the synthetic toner images are formed while leaving a certain margin from four edges of the recording material S. In this embodiment, a leading end margin is about 2-3 mm. The synthetic toner images are collectively secondary-transferred onto the recording material S in the color image secondary transfer portion N2A in the above-described manner. Thereafter, the synthetic toner images are fixed on the recording material S by the first fixing device 101 or by the first fixing device 101 and the second fixing device 102.

In the case of the one-side image formation, the recording material S on which the toner image is fixed at one surface is introduced into the transparent image forming apparatus 200 by a second flapper 110 as the switching means without being introduced into a both side path 113. The second flapper 110 switches the conveyance direction of the recording material S between the direction toward the transparent image forming apparatus 200 and the direction toward a reverse path 111. To the second flapper 110, the recording material S is conveyed from the first after-fixing path 116 or the third after-fixing path 118.

In the case of both side image formation, the recording material S is, after the toner image is fixed on the first surface by the first fixing device 101 or by the first and second fixing devices 101 and 102, guided to the reverse path 111 by the second flapper 110. Thereafter, the recording material S is turned upside down by a reversing roller 112 and is guided to the both side path 113. Then, the recording material S passes again through the registration roller 114, the pre-transfer guide and the color image secondary transfer portion N2A and then the toner image is transferred onto the second surface and is fixed on the second surface by the first fixing device 101 or by the first and second fixing devices 101 and 102. Then, during the image formation on the second surface, the second flapper 110 is switched, so that the recording material S on which the toner images are fixed on both surfaces is delivered to the transparent image forming apparatus 200. At this time, the recording material S is once guided to the reverse path 111 by switching the second flapper 110 and then is returned by the reversing roller 112 to be turned upside down. Thereafter, the recording material S can also be delivered to the transparent image forming apparatus 200. This operation can be used for, e.g., properly sorting sheets of the recording material S to be discharged from the image forming system A.

In this embodiment, the second flapper 110, the reverse path 111, the reversing roller 112, the both side path 113 and the like constitute a first both side means for conveying the recording material S, on which the color toner images are fixed on one surface, to the color image secondary transfer portion N2A in order to form the color toner images on the other surface.

1-2. Transparent Image Forming Apparatus

The transparent image forming apparatus 200 employs the electrophotographic type, the tandem type and the intermediary transfer type and is capable of forming the transparent image with the transparent toner which becomes transparent after the fixing.

In the transparent image forming apparatus 200, the fifth image forming portion Pe is provided and the transparent toner image is formed with the transparent toner by the electrophotographic image forming process.

The fifth image forming portion Pe includes a drum-like electrophotographic photosensitive member as a first image bearing member on which a toner image is to be formed, i.e., a photosensitive drum 3*e*. On the photosensitive drum 3*e*, the transparent toner image is formed. Adjacently to the photosensitive drum 3*e*, an intermediary transfer member 220 as a second image bearing member onto which the toner image is to be transferred from the first image bearing member is provided. The toner image formed on the photosensitive drum 3*e* is primary-transferred onto the intermediary transfer member 220 at a primary transfer portion N1*e* and then is secondary-transferred onto the recording material S at a secondary transfer portion (for color image) N2B. The recording material S on which the transparent toner image is transferred is heated and pressed by a third fixing device 203, so that the toner image is fixed on the recording material S and then is discharged as a recording image to the outside of image forming apparatus 200.

The photosensitive drum 3*e* is rotationally driven in an arrow R1 direction in FIG. 1. At the fifth image forming portion Pe, around the photosensitive drum 3, the following means are provided. First, a charging roller 2*e* as a charging means is provided. Next, a developing device 1*e* as a developing means is provided. Next, a transfer roller 6*e* as a primary transfer means is provided. Next, a cleaner 4*e* as a cleaning means is provided. Further, at the fifth image forming portion Pe, above the photosensitive drum 3*e* in FIG. 1, a laser scanner 5*e* as an exposure means is provided.

In the laser scanner 5*e*, a light source device, a polygon mirror and the like are provided. The laser scanner 5*e* scans the surface of the photosensitive drum 3*e* with laser light emitted from the light source device while rotating the polygon mirror and defects light flux of the laser (scanning) light by a reflection mirror and then focuses the light flux on a generating line of the photosensitive drum 3*e* through *f*θ lens, thus effecting light exposure. As a result, an electrostatic latent image (electrostatic image) depending on an image signal is formed on the photosensitive drum 3*e*.

In the developing device 1*e*, as a developer, a transparent toner is filled, in a predetermined amount. The developing device 1*e* develops the electrostatic latent image on the photosensitive drum 3*e* to form a transparent image. To the developing device 1*e*, a toner is timely supplied by a supplying device.

The intermediary transfer member 220 is formed with an endless belt (intermediary transfer belt) and is extended around a tension roller 221, a secondary transfer opposite roller 222 and a driving roller 223. The intermediary transfer member 220 is rotationally driven in an arrow R2 direction in FIG. 1 at the same peripheral speed as that of the photosensitive drum 3*e*.

At an inner peripheral surface of the intermediary transfer member 220, the primary transfer roller 6*e* is disposed opposed to the associated photosensitive drum 3*e*. The primary transfer roller 6*e* is urged toward the associated photosensitive drum 3*e* to form the primary transfer portion (primary transfer nip) N1*e* where the photosensitive drum 3*e* contacts the intermediary transfer member 220. Further, at an outer peripheral surface of the intermediary transfer member 220, a secondary transfer roller 215 as a secondary transfer means is disposed opposed to the secondary transfer opposite roller 222. The secondary transfer roller 215 is urged toward the secondary transfer opposite roller 222 to form a secondary transfer portion for transparent image (secondary transfer nip for transparent image) N2B where the intermediary transfer member 220 contacts the secondary transfer roller 215. The secondary transfer roller 215 is shaft-supported substantially in parallel to the intermediary transfer member 220 and is provided in contact with the outer peripheral surface of the intermediary transfer member 220.

The toner image formed on the photosensitive drum 3*e* is primary-transferred onto the outer peripheral surface of the intermediary transfer member 220 in a process in which the toner image passes through the primary transfer portion N1*e*. At this time, to the primary transfer roller 6*e*, from a primary transfer power source as a voltage applying means, a primary transfer bias which is a DC voltage of an opposite polarity to a normal charge polarity of the toner is applied. The transparent toner image on the photosensitive drum 3*e* is primary-transferred onto the intermediary transfer member 220 by an electric field formed in the primary transfer portion N1*e* by the primary transfer bias and pressure exerted between the photosensitive drum 3*e* and the intermediary transfer member 220.

The toner image transferred on the intermediary transfer member 220 is secondary-transferred onto the recording material S in a process in which the toner image passes through the transparent image secondary transfer portion N2B. At this time, from a secondary transfer power source as the voltage applying means, a secondary transfer bias which is a DC voltage of the opposite polarity to the normal charge polarity of the toner is applied to the secondary transfer roller 215. The toner image on the intermediary transfer member 220 is secondary-transferred onto the recording material S by an electric field formed in the transparent image secondary transfer portion N2B by the secondary transfer bias and pressure exerted between the intermediary transfer member 220 and the recording material S.

The recording material S is delivered from the color image forming apparatus 100 to the transparent image forming apparatus 200 and is introduced into a before-transfer path 201 for the transparent image by a third flapper 209 as the switching means. The third flapper 209 switches the conveyance direction of the recording material S to the direction toward the before transfer path 201 for the transparent image and the direction toward a circumventing path (bypass) 202 described later. The recording material S passes through the before-transfer path 201 for the transparent image, a registration roller 214 and a pre-transfer guide and then is sent to the transparent image secondary transfer portion N2B with predetermined timing. In synchronism with this timing, the secondary transfer bias is applied to the secondary transfer roller 215.

The toner (primary transfer residual toner) remaining on the photosensitive drum 3*e* after the primary transfer is ended is removed and collected by the cleaner 4*e*. The cleaned photosensitive drum 3*e* is subjected to subsequent formation of the electrostatic latent image. Further, the toner (secondary transfer residual toner) and other foreign matter which remain on the intermediary transfer member 220 after the secondary transfer is ended are wiped with a cleaning web (nonwoven fabric) 230 by bringing the cleaning web into contact with the surface of the intermediary transfer member 220.

In this embodiment, the transparent image forming means is constituted by the fifth image forming portion Pe, the intermediary transfer member 220, the secondary transfer roller 215 and the like. Further, the transparent image secondary transfer portion N2B constitutes a portion where the transparent toner image is formed on the recording material S by the transparent image forming means.

The recording material S on which the transparent toner image is transferred is introduced into the third fixing device 203. The toner image is fixed on the recording material S by applying heat and pressure to the recording material S by the third fixing device 203.

In the case of the one-side image formation, the recording material S on which the transfer toner image is fixed at one surface by the third fixing device 203 is discharged as a recording image to the outside of the transparent image forming apparatus 200 by a fourth flapper 210 as the switching means without being introduced into the both side path 213. The fourth flapper 210 switches the conveyance direction of the recording material S between the direction toward the outside of the transparent image forming apparatus 200 and the direction toward a reverse path 211.

In the case of both side image formation, the recording material S is, after the toner image is fixed on the first surface by the third fixing device 203, guided to the reverse path 211 by the fourth flapper 210. Thereafter, the recording material S is turned upside down by a reversing roller 212 and is guided to the both side path 213. Then, the recording material S passes again through the registration roller 214, the pre-transfer guide and the transparent image secondary transfer portion N2B and then the toner image is transferred onto the second surface and is fixed on the second surface by the third fixing device 203. Then, during the image formation on the second surface, the fourth flapper 210 is switched, so that the recording material S on which the toner images are fixed on both surfaces is delivered to the transparent image forming apparatus 200. At this time, the recording material S is once guided to the reverse path 211 by switching the fourth flapper 210 and then is returned by the reversing roller 212 to be turned upside down. Thereafter, the recording material S can also be discharged to the outside of the transparent image forming apparatus 200. This operation can be used for, e.g., properly sorting sheets of the recording material S to be discharged from the image forming system A.

In this embodiment, the fourth flapper 210, the reverse path 211, the reversing roller 212, the both side path 213 and the like constitute a second both side means for conveying the recording material S, on which the color toner images are fixed on one surface, to the transparent image secondary transfer portion N2B in order to form the transparent toner images on the other surface.

The circumventing path 202 is the conveyance path which performs, when the transparent image is not formed, the function of discharging the recording material S to the outside of the transparent image forming apparatus 200 without passing the recording material S through the transparent image secondary transfer portion N2B and the third fixing device 203. That is, the circumventing path 202 constitutes a circumventing means for causing the recording material S, on which the color images are formed on at least one of the first and second surfaces of the recording material S by the color image forming apparatus 100, to circumvent the transparent image secondary transfer portion N2B and the fixing portion N3 of the third fixing device 203 to be discharged to the outside of the transparent image forming apparatus 200. As a result, as described later, in the case where the transparent image is not formed on the both (first and second) surfaces of the recording material S, the recording material S is prevented from passing through the third fixing device 203 of the transparent image forming apparatus 200, so that the number of times the recording material S passes through the fixing devices can be further reduced.

The first after-fixing path 116, the second after-fixing path 117, the third after-fixing path 118, the before-transfer path 201 for the transparent image, the circumventing path 202, and the like are the conveyance paths through which the recording material S passes are constituted by guide members for regulating movement locus of the recording material S. The reverse paths 111 and 211, the both side paths 113 and 213 and the like are also similarly constituted. Further, each flapper is constituted by a regulating member or the like for opening one of the branched conveyance paths for the recording material S so as to permit passage of the recording material S and for closing the other conveyance path so as to prevent passage of the recording material S.

2. Fixing Device

The first to third fixing devices (image heating devices) 101, 102 and 203 in this embodiment will be described. In this embodiment, the first to third fixing devices 101, 102 and 203 have the substantially same constitution and therefore description will be made by using the first fixing device 101 as an example.

Figure 2:
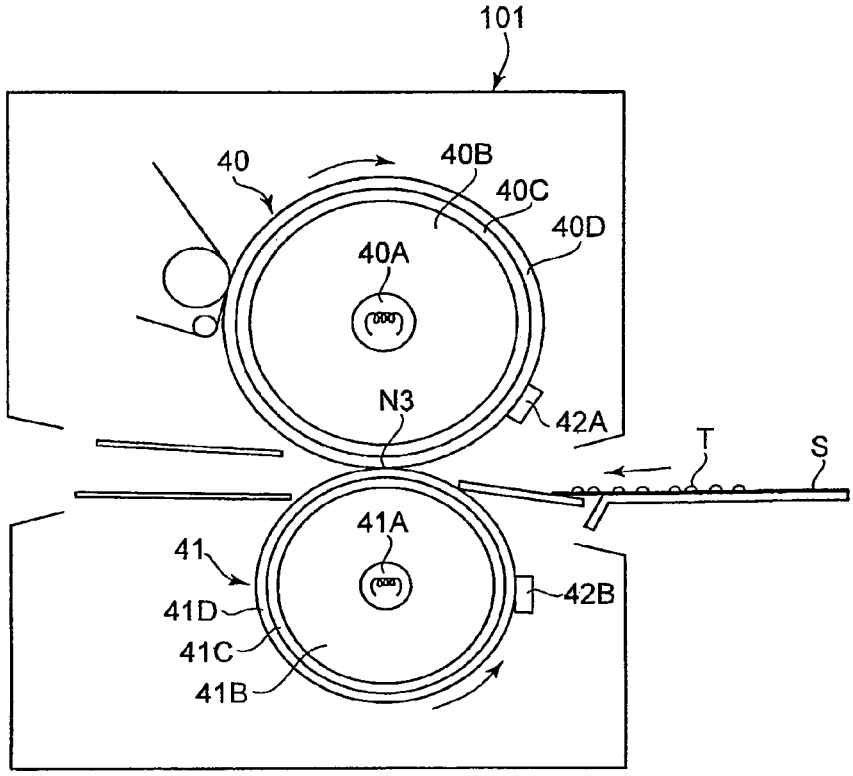
FIG. 2 is a schematic sectional view of a fixing device of the image forming system in the embodiment.

FIG. 2 is a schematic sectional view of the first fixing device 101. The first fixing device 101 includes a fixing roller 40 as a fixing member and a pressing roller 41 as a pressing member. The fixing member contacts and heats the surface of the recording material S on which the toner image is transferred thereon in the immediately-before secondary transfer step. The fixing roller 40 is a roller which internally includes a halogen heater 40A as a heat-generating member and which has an outer diameter of 80 mm. The pressing roller 41 is a roller which internally includes a halogen heater 41A as the heat-generating member and which has an outer diameter of 60 mm.

The fixing roller 40 includes a core metal 40B formed of aluminum, iron or the like in a cylindrical shape. Further, the fixing roller 40 includes an elastic layer 40C formed with a silicone rubber and positioned on the outer peripheral surface of the core metal 40B. Further, the fixing roller 40 includes a parting layer 40D which is formed with a tube of fluorine-containing resin such as PFA (tetrafluoroethylene-perfluoroalkylvinyl ether copolymer) or PTFA (polytetrafluoroethylene) and which coats the outer peripheral surface of the elastic layer 40C.

A surface temperature of the fixing roller 40 is detected by a thermistor 42A as a temperature detecting means. The detected surface temperature is inputted into a controller 302 (described later) as a control means of the image forming apparatus 100. Then, by the controller, the surface temperature of the fixing roller 40 is controlled as to be in a predetermined temperature range. In this embodiment, in order to meet various types of the recording materials S, depending on the type (basis weight) of the recording material S, a target center temperature within a range of 135° C.-200° C. As a result, the fixing process is performed with productivity of 60 sheets per minute irrespective of the basis weight of the recording material S.

The pressing roller 41 includes a core metal 41B formed of aluminum, iron or the like in a cylindrical shape. Further, the pressing roller 41 includes an elastic layer 41C formed with a silicone rubber and positioned on the outer peripheral surface of the core metal 41B. Further, the pressing roller 41 includes a parting layer 41D which is formed with a tube of fluorine-containing resin such as PFA or PTFA and which coats the outer peripheral surface of the elastic layer 41C. The pressing roller 41 is urged by an urging spring as an urging member (means) and is press-contacted to the fixing roller 40 from below in FIG. 2. As a result, the fixing roller 40 and the pressing roller 41 press-contact each other with total pressure of about 784N (about 80 kgf). Further, the fixing roller 40 and the pressing roller 41 are disposed so as to be rotatable while being press-contacted to each other.

The surface temperature of the pressing roller 41 is, similarly as in the case of the fixing roller 40, detected by a thermistor 42B as a temperature detecting means and is controlled by the controller 302 (FIG. 3) depending on a detection result of the thermistor 42B.

When the fixing roller 40 is rotated in the clockwise direction in FIG. 2 by being driven by a motor as a driving source, the pressing roller 41 is rotated in the counterclockwise direction in FIG. 2 by the rotation of the fixing roller 40. The recording material S on which the toner image is formed is nip-conveyed between the fixing roller 40 and the pressing roller 41 in the fixing portion (fixing nip) N3 formed by contact between the fixing roller 40 and the pressing roller 41, thus being heated and pressed. As a result, the toner image T is fixed on the recording material S.

In this embodiment, the first to third fixing devices 101, 102 and 203 include first to third fixing members, respectively. Further, the first to third fixing devices 101, 102 and 103 form the first to third fixing portions N3, respectively.

Incidentally, the heating means for the fixing member and/or the pressing member is not limited to the halogen heater. Further, as the fixing member and/or the pressing member, e.g., a belt-like urging member such as an endless belt may also be used.

3. Toner

The toner used in this embodiment will be described. In this embodiment, as a base material (a binder) for the color toners (colored toners), a polyester resin material was used. As a color toner manufacturing method, a pulverization method was used. As the toner manufacturing method, it is also possible to use a suspension polymerization method, an interfacial polymerization method, and a dispersion polymerization method. A toner component and the manufacturing method are not limited to those described above. As the base material for the transparent toner (clear toner), the same polyester resin material as that for the color toner was used. The transparent toner was manufactured without mixing a color pigment, different from the case of the color toners.

As the base material (binder) for the color toners, the polyester resin material having a glass transition point (temperature) (Tg) of 45° C. to 60° C. is generally used. The transparent toner is not necessarily transparent. For example, the transparent toner used in this embodiment is white in an unfixed state. This is because the transparent toner is pulverized so as to provide a particle size of about 5 μm to about 10 μm. As the surface of the transparent toner pulverized in the particle size of about 5 μm to about 10 μm, light is scattered, so that transmitted or absorbed light is decreased in amount. For that reason, the transparent toner looks white to human eyes.

The glass transition point (Tg) is not particularly limited. When the type or molecular weight of the resin material for the transparent toner is changed, a melting property of the transparent toner is changed. For that reason, when the toners in the same amount are fixed under the same fixing condition, different glossiness values are obtained. Specifically, the glossiness is liable to increase when the base material having a low glass transition point (i.e., a meltable base material) is used. Further, the glossiness is liable to lower when the base material having a high glass transition point (i.e., a less meltable base material) is used.

In this embodiment, the glass transition points of the color toners and the transparent toner were substantially equal to each other. However, the glass transition point of the transparent toner can also be higher or lower than that of the color toners.

Further, even in the case where the toners having the same glass transition point are used, e.g., when energy provided to the toner is increased by decreasing the fixing speed or by increasing the fixing temperature, the glossiness is liable to increase.

Figure 3:
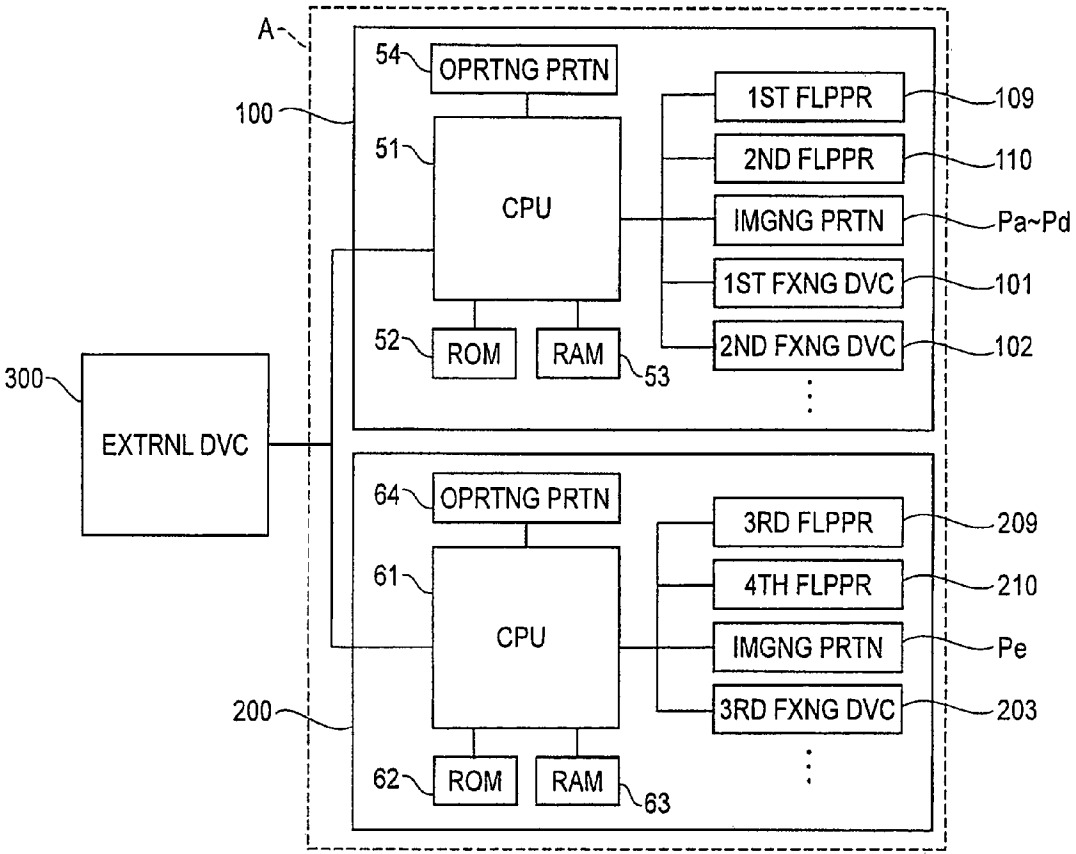
FIG. 3 is a schematic block diagram showing control of the image forming system in the embodiment.

FIG. 3 is a schematic block diagram of control of the image forming system A in this embodiment. The operation of the color image forming apparatus 100 is subjected to integrated control by a CPU 51, as a computing control circuit which is a central control element, provided in the controller of the color image forming apparatus 100. Particularly, in this embodiment, the CPU 51 controls the color toner image forming operations on the recording material S by using the first to fourth image forming portions Pa to Pd and the operations of the first and second fixing devices 101 and 102 for fixing the toner images on the recording material S. Further, the CPU 51 controls a conveyance path changing operation of the recording material S in the color image forming apparatus 100 by controlling switching of the route of the recording material S by the first and second flappers 109 and 110 and the like. The CPU 51 executes control of the operation of the color image forming apparatus 100, information transmission with the transparent image forming apparatus 200 and various control operations such as a process for judging the conveyance path of the recording material S described later in accordance with the programs and data stored in ROM 52 and RAM 53 as storing means.

Further, the operation of the transparent image forming apparatus 200 is subjected to integrated control by a CPU 61, as a computing control circuit which is a central control element, provided in the controller of the transparent image forming apparatus 200. Particularly, in this embodiment, the CPU 61 controls the transparent toner image forming operation on the recording material S by using the fifth image forming portion Pe and the operations of the third-fixing device 203 for fixing the transparent toner image on the recording material S. Further, the CPU 61 controls a conveyance path changing operation of the recording material S in the transparent image forming apparatus 200 by controlling switching of the route of the recording material S by the third and fourth flappers 209 and 210 and the like. The CPU 61 executes various control operations such as control of the operation of the transparent image forming apparatus 200 and information transmission with the color image forming apparatus 100 in accordance with the programs and data stored in ROM 62 and RAM 63 as storing means.

In this embodiment, in the color image forming apparatus 100 and the transparent image forming apparatus 200, control portions provided for the respective image forming apparatuses transmit information to each other and the respective CPUs 51 and 61 synchronize the conveyance of the recording material S and image forming timing. Further, in this embodiment, particularly, the CPU 51 of the controller of the color image forming apparatus 100 effects the process for judging the conveyance path of the recording material S described later in accordance with the information from the external device 300 and the operating portion 54. The CPU 51 of the controller of the color image forming apparatus 100 controls, in accordance with a result of the judgment, the conveyance path changing operation of the recording material S in the color image forming apparatus 100. The CPU 51 of the controller of the color image forming apparatus 100 transmits the result of the judgment to the CPU 61 of the controller of the transparent image forming apparatus 200, so that the conveyance path changing operation of the recording material S in the transparent image forming apparatus 200 is controlled by the CPU 61. A control device for controlling the conveyance path of the recording material S in the image forming system A is constituted by these CPUs 51 and 61.

To the CPUs 51 and 61, the image information is sent from an external device 300 such as a personal computer or an image reading device (not shown) provided in, e.g., the color image forming apparatus 100. Further, to the CPUs 51 and 61, information for instructing the operation in the image forming mode such as whether or not the image formation is effected on one surface or both surfaces or whether or not the transparent image is formed on what surface.

5. Change in Conveyance Path of Recording Material

Next, a conveyance path changing mode of the recording material S in the image forming system A in this embodiment depending on the presence or absence of the both side image forming operation, or on the presence or absence of the transparent image forming operation will be described.

Figure 4:
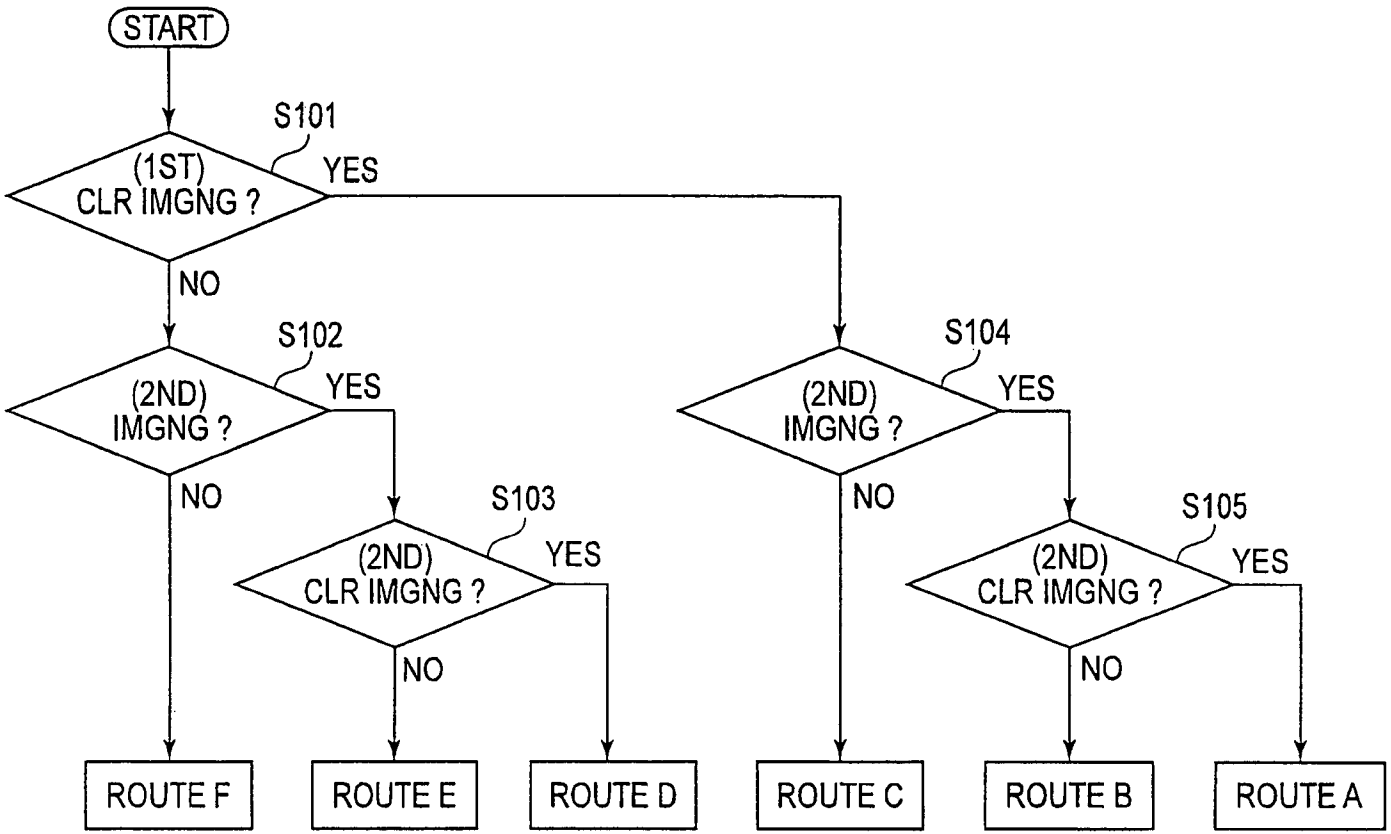
FIG. 4 is a flow chart for illustrating discriminating processing of a conveyance path of a recording material in the present invention.

FIG. 4 is a flow chart for illustrating a procedure of a conveyance path discriminating operation of the recording material S in the image forming system A in this embodiment.

First, the CPU 51 judges whether or not the transparent image is should be formed on the first surface (S101). Next, the CPU 51 judges whether or not the image formation on the second surface should be effected (S102). Then, the CPU 51 judges whether or not the transparent image should be formed on the second surface (S103, S105). As a result, either one of six routes A, B, C, D, E and F provided for the image forming system A in this embodiment is selected as the recording material S conveyance path.

Incidentally, the CPU 51 performs processing for selecting the above routes on the basis of information on an instruction to form the one-side (surface) image or the both side (surface) image and information on an instruction to form the transparent image on the first surface or the second surface, which are provided in an image formation instruction signal from a computer 300 or an image formation instruction signal from the operating portion 54.

The respective routes will be described below. In the following examples, the front surface of the recording material S in the first surface and the image formation is started from the color image formation on the first surface. Then, as necessary, the recording material S is turned upside down as described above and then the recording material S is delivered from the color image forming apparatus 100 to the transparent image forming apparatus 200. When the image can be formed on the front surface (first surface) and the back surface (second surface) along the side routes shown in FIG. 4, whether the image formation should be started from what surface and whether or not the recording material S should be delivered from the color image forming apparatus 100 to the transparent image forming apparatus 200 after the recording material S is turned upside down can be arbitrarily selected.

Table 1 shown below includes combinations of the images formed on the first and second surfaces. In Table 1, "CL" represents that the color images are formed by the color image forming apparatus 100 and "TR" represents that the transparent (clear) image is formed by the transparent image forming apparatus 200.

TABLE 1

| Route | A | B | C | D | E | F |
|---|---|---|---|---|---|---|
| 1ST*[1] | CL + TR | CL + TR | CL + TR | CL | CL | CL |
| 2ND*[2] | CL + TR | CL | — | CL + TR | CL | — |

*[1]"1ST" represents the first surface of the recording material S.
*[2]"2ND" represents the second surface of the recording material S.

(1) Route A

In the procedure shown in FIG. 4, the CPU 51 selects the route A in the case of "YES" in S101, "YES" in S104 and "YES" in S105. The route A is the conveyance path of the recording material S in the case where the color image and the transparent image are formed on the both sides (surfaces) of the recording material S. In the route A, the order of the respective constituent elements through which the recording material S passes is roughly as follows:

Recording material cassette 10, registration roller 114, color image secondary transfer portion N2A, first fixing device 101 (first surface), first flapper 109, first after fixing path 116, second flapper 110, reverse path 111, reversing roller 112, both side path 113, registration roller 114, color image secondary transfer portion N2A, first fixing device 101 (second surface), first flapper 109, first after-fixing path 116, second flapper 110, reverse path 111 (along which the recording material S is turned upside down before delivery), second flapper 110, third flapper 209, transparent image before-transfer path 201, registration roller 214, transparent image secondary transfer portion N2B, third fixing device 203 (first surface), fourth flapper 210, transparent image secondary transfer portion N2B, third fixing device 203 (first surface), fourth flapper 210, reverse path 211, reversing roller 212, both side path 213, registration roller 214, transparent image secondary transfer portion N2B, third fixing device (second surface), fourth flapper 210 and discharge to the outside of the image forming system (job end).

Incidentally, a reversing operation for turning the recording material S upside down along the reverse path 111 may also be eliminated by fixing the toner image on each of the surfaces of the recording material S along the following route: second surface (color), first surface (color), first surface (transparent) and second surface (transparent) or first surface (color), second surface (color), second surface (transparent) and first surface (transparent). In the latter case, the recording material S may also be turned or not turned upside down along the reverse path 211 before the discharge of the recording material S.

(2) Route B

In the procedure shown in FIG. 4, the CPU 51 selects the route B in the case of "YES" in S101, "YES" in S104 and "NO" in S105. The route B is the conveyance path of the recording material S in the case where the color image and the transparent image are formed on the first surface but only the color image is formed on the second surface (i.e., the transparent image is not formed on the second surface). In the route B, the order of the respective constituent elements through which the recording material S passes is roughly as follows:

Recording material cassette 10, registration roller 114, color image secondary transfer portion N2A, first fixing device 101 (first surface), first flapper 109, second after fixing path 117, second fixing device 102 (second surface), third after-fixing path 118, second flapper 110, reverse path 111, reversing roller 112, both side path 113, registration roller 114, color image secondary transfer portion N2A, first fixing device 101 (second surface), first flapper 109, first after-fixing path 116, second flapper 110, reverse path 111 (along which the recording material S is turned upside down before delivery), second flapper 110, third flapper 209, transparent image before-transfer path 201, registration roller 214, transparent image secondary transfer portion N2B, third fixing device 203 (first surface), fourth flapper 210, transparent image secondary transfer portion N2B, third fixing device 203 (first surface), fourth flapper 210, reverse path 211 (along which the recording material S is turned upside down before delivery), fourth flapper 210 and discharge to the outside of the image forming system (job end).

Incidentally, a reversing operation for turning the recording material S upside down along the reverse path 111 may also be eliminated by fixing the toner image on each of the surfaces of the recording material S along the following route: second surface (color), first surface (color) and first surface (transparent). Further, the reversing operation of the recording material S along the reverse path 211 before the discharge of the recording material S may also be eliminated.

(3) Route C

In the procedure shown in FIG. 4, the CPU 51 selects the route C in the case of "YES" in S101 and "NO" in S104. The route C is the conveyance path of the recording material S in the case where the color image and the transparent image are formed on the first surface but the image formation is not effected. In the route C, the order of the respective constituent elements through which the recording material S passes is roughly as follows:

Recording material cassette 10, registration roller 114, color image secondary transfer portion N2A, first fixing device 101 (first surface), first flapper 109, second after fixing path 117, second fixing device 102 (second surface), third after-fixing path 118, second flapper 110, third flapper 209, transparent image before-transfer path 201, registration roller 214, transparent image secondary transfer portion N2B, third fixing device 203 (first surface), fourth flapper 210, transparent image secondary transfer portion N2B, third fixing device 203 (first surface), fourth flapper 210, reverse path 211 (along which the recording material S is turned upside down before delivery) and discharge to the outside of the image forming system (job end).

Incidentally, a reversing operation for turning the recording material S upside down along the reverse path 111 may also be eliminated by fixing the toner image on each of the surfaces of the recording material S along the following route: second surface (color), first surface (color) and first surface (transparent). Further, the reversing operation of the recording material S along the reverse path 211 before the discharge of the recording material S may'also be eliminated.

(4) Route D

In the procedure shown in FIG. 4, the CPU 51 selects the route D in the case of "NO" in S101, "YES" in S102 and "YES" in S103. The route D is the conveyance path of the recording material S in the case where only the color image is formed on the first surface (i.e., the transparent image is not formed on the first surface) and the color image and the transparent image are formed on the second surface. In the route D, the order of the respective constituent elements through which the recording material S passes is roughly as follows:

Recording material cassette 10, registration roller 114, color image secondary transfer portion N2A, first fixing device 101 (first surface), first flapper 109, second after-fixing path 117, second fixing device 102 (first surface), third after-fixing path 118, second flapper 110, reverse path 111, reversing roller 112, both side path 113, registration roller 114, color image secondary transfer portion N2A, first fixing device 101 (second surface), first flapper 109, first after-fixing path 116, second flapper 110, third flapper 209, transparent image before-transfer path 201, registration roller 214, transparent image secondary transfer portion N2B, third fixing device 203 (second surface), fourth flapper 210 and discharge to the outside of the image forming system (job end).

(5) Route E

In the procedure shown in FIG. 4, the CPU 51 selects the route E in the case of "NO" in S101, "YES" in S102 and "NO" in S103. The route E is the conveyance path of the recording material S in the case where only the color image is formed on the both surfaces (i.e., the transparent image is not formed on the both surfaces). In the route E, the order of the respective constituent elements through which the recording material S passes is roughly as follows:

Recording material cassette 10, registration roller 114, color image secondary transfer portion N2A, first fixing device 101 (first surface), first flapper 109, second after-fixing path 116, second fixing device 102 (second surface), third after-fixing path 118, second fixing device 110, third after-fixing path 209, circumventing path (bypass) 202 and discharge to the outside of the image forming system (job end).

(6) Route F

In the procedure shown in FIG. 4, the CPU 51 selects the route F in the case of "NO" in S101 and "NO" in S102. The route F is the conveyance path of the recording material S in the case where only the color image is formed on the first surface (i.e., the transparent image is not formed on the first surface) and the image formation is not effected on the second surface. In the route F, the order of the respective constituent elements through which the recording material S passes is roughly as follows:

Recording material cassette 10, registration roller 114, color image secondary transfer portion N2A, first fixing device 101 (first surface), first flapper 109, second after-fixing path 117, second fixing device 102 (first surface), third after-fixing path 118, second flapper 110, reverse path 111 (along which the recording material S is turned upside down before delivery), second flapper 110, third flapper 209, circumventing path (bypass) 202 and discharge to the outside of the image forming system (job end).

Incidentally, the reversing operation of the recording material S along the reverse path 111 in the color image forming apparatus 100 may also be eliminated.

6. Comparative Embodiment

For comparison with the image forming system A in Embodiment 1, in the conveyance path in a comparative embodiment the recording material S in the color image forming apparatus is always passed through the two fixing devices. For convenience, constituent elements corresponding to those in the image forming system A in Embodiment 1 are represented by the same reference numerals or symbols and will be described with reference to FIG. 1. However, in the comparative embodiment, the first flapper 109 and the first after-fixing path 116 provided in the image forming system A in Embodiment 1 are not provided.

Similarly as in the image forming system A in Embodiment 1, also the comparative embodiment, the six routes A to F can be used as the recording material conveyance path depending on the presence or absence of the both side image forming operation or the transparent image forming operation. For avoiding complication, the passing order of the respective constituent elements through which the recording material S passes is as follows:

(1) Route A

Color image secondary transfer portion N2A, first fixing device 101 (first surface), second fixing device 102 (first surface), both side path 113, color image secondary transfer portion N2A, first fixing device (second surface), second fixing device 102 (second surface), reverse path 111 (along which the recording material S is turned upside down before delivery), transparent image secondary transfer portion N2B, third fixing device 203 (first surface), both side path 213, transparent image secondary transfer portion N2B (second surface), third fixing device 203 (second surface) and discharge to the outside of the image forming system (job end).

(2) Route B

Color image secondary transfer portion N2A, first fixing device 101 (first surface), second fixing device 102 (first surface), both side path 113, color image secondary transfer portion N2A, first fixing device (second surface), second fixing device 102 (second surface), reverse path 111 (along which the recording material S is turned upside down before delivery), transparent image secondary transfer portion N2B, third fixing device 203 (first surface), reverse path 211 (along which the recording material S is turned upside down before delivery) and discharge to the outside of the image forming system (job end).

(3) Route C

Color image secondary transfer portion N2A, first fixing device 101 (first surface), second fixing device 102 (first surface), reverse path 211 (along which the recording material S is turned upside down before delivery) and discharge to the outside of the image forming system (job end).

(4) Route D

Color image secondary transfer portion N2A, first fixing device 101 (first surface), second fixing device 102 (first surface), both side path 113, color image secondary transfer portion N2A, first fixing device (second surface), second fixing device 102 (second surface), transparent image secondary transfer portion N2B, third fixing device 203 (second surface) and discharge to the outside of the image forming system (job end).

(5) Route E

Color image secondary transfer portion N2A, first fixing device 101 (first surface), second fixing device 102 (first surface), both side path 113, color image secondary transfer portion N2A, first fixing device (second surface), second fixing device 102 (second surface), circumventing path (bypass) 202 and discharge to the outside of the image forming system (job end).

(6) Route F

Color image secondary transfer portion N2A, first fixing device 101 (first surface), second fixing device 102 (first surface), reverse path 111 (along which the recording material S is turned upside down before delivery and discharge), circumventing path (bypass) 202 and discharge to the outside of the image forming system (job end).

7. Effect

Table 2 shown below shows the number of times each of the first surface and the second surface of the recording material passes through the fixing device along each of the above routes A to F (hereinafter simply referred to as fixing device passing number). Here, with respect to one of the surfaces of the recording material S, the passing of the surface through the fixing device means that the recording material S passes through the fixing portion (fixing nip N3 with the surface directed toward the fixing member.

TABLE 2

| Route | A | B | C | D | E | F |
|---|---|---|---|---|---|---|
| 1ST*1 | 2 | 2 | 2 | 2 | 2 | 2 |
| 2ND*2 | 2 | 2 | — | 2 | 2 | — |

*1"1ST" represents the first surface of the recording material S.
*2"2ND" represents the second surface of the recording material S.

Table 3 shown below shows the fixing device passing number of each of the first surface and the second surface of the recording material along each of the above routes A to F in the comparative embodiment (i.e., in the case where the recording material S always passes through the first and second fixing devices 101 and 102 in the color image forming apparatus 100 irrespective of the presence or absence of the transparent image forming operation.

TABLE 3

| Route | A | B | C | D | E | F |
|---|---|---|---|---|---|---|
| 1ST*1 | 3 | 3 | 3 | 2 | 2 | 2 |
| 2ND*2 | 3 | 2 | — | 3 | 2 | — |

*1"1ST" represents the first surface of the recording material S.
*2"2ND" represents the second surface of the recording material S.

When the results of Tables 2 and 3 are compared, with respect to the routes A, B, C and D (the case where at least one of the first surface and the second surface is subjected to the transparent image formation), the following results can be obtained.

(1) First, with respect to the routes A, B, C and D, in Embodiment 1, the fixing device passing number of the surface of the recording material S subjected to the transparent image formation can be reduced. That is, in Embodiment 1, the fixing device passing number of the surface of the recording material S subjected to the transparent image formation is 2. On the other hand, in the comparative embodiment, the fixing device passing number of the surface of the recording material S subjected to the transparent image formation is 3.

(2) Further, with respect to the routes B and D (the case where the image formation is effected on both surfaces and only one of the first surface and the second surface is subjected to the transparent image formation), in Embodiment 1, the difference in fixing device passing number between the first and second surfaces can be reduced. That is, with respect to the routes B and D, the fixing device passing number difference can be decreased from 1 in the comparative embodiment to zero in Embodiment 1.

In order to check the effect of Embodiment 1, sampling was made by using the following recording material (sheet) and image.

Recording material: Quality paper (basis weight: 80 g/m$^2$)

Image: Cyan image (toner amount per unit area: 0.5 mg/cm$^2$)

First, a relationship between the fixing device passing number and glossiness in an area of the recording material on which the image was formed is shown in Table 4 below. Incidentally, for the glossiness measurement, a handy gloss meter ("PG-1M", mfd. by Nippon Denshoku Industries Co., Ltd.) according to JIS Z 8741 (specular glossiness-measuring method) was used.

TABLE 4

| FDPN*1 | Glossiness (deg.) |
|---|---|
| 1 | 15 |
| 2 | 30 |
| 3 | 45 |

*1"FDPN" represents the fixing device passing number.

Further, with respect to the results shown in Table 2 for the first surface and the second surface in each of the routes A to F in Embodiment 1, the image glossiness shown in Table 4 is correspondingly indicated in Table 5 below.

Further, with respect to the results shown in Table 2 for the first surface and the second surface in each of the routes A to F in Embodiment 1, the image glossiness shown in Table 4 is correspondingly indicated in Table 5 below.

TABLE 5

| Route | A | B | C | D | E | F |
|---|---|---|---|---|---|---|
| 1ST*1 | 30 | 30 | 30 | 30 | 30 | 30 |
| 2ND*2 | 30 | 30 | — | 30 | 30 | — |

*1"1ST" represents the first surface of the recording material S.
*2"2ND" represents the second surface of the recording material S.

Similarly, with respect to the results shown in Table 2 for the first surface and the second surface in each of the routes A to F in the comparative embodiment, the image glossiness shown in Table 4 is correspondingly indicated in Table 6 below.

TABLE 6

| Route | A | B | C | D | E | F |
|---|---|---|---|---|---|---|
| 1ST*1 | 45 | 45 | 45 | 30 | 30 | 30 |
| 2ND*2 | 45 | 30 | — | 45 | 30 | — |

*1"1ST" represents the first surface of the recording material S.
*2"2ND" represents the second surface of the recording material S.

When the results of Tables 5 and 6 are compared, with respect to the routes A, B, C and D (the case where at least one of the first surface and the second surface is subjected to the transparent image formation), the following results can be obtained.

(1) First, with respect to the routes A, B, C and D, in Embodiment 1, the glossiness can be made 30 degrees or less with respect to both of the first surface and the second surface.

(2) Further, with respect to the routes B and D (the case where the image formation is effected on both surfaces and only one of the first surface and the second surface is subjected to the transparent image formation), in Embodiment 1, the difference in glossiness between the first and second surfaces can be reduced. That is, with respect to the routes B and D, the glossiness difference can be decreased from 15 in the comparative embodiment to zero in Embodiment 1.

As described above, with respect to the surface of the recording material S subjected to the transparent image formation, in the color image forming apparatus 100, the conveyance path of the recording material S is selected so that the recording material S passes through only the first fixing device 102 of the first and second fixing devices 101 and 102. As a result, the fixing device passing number of the surface of the recording material S on which the transparent image is to be formed can be reduced. Therefore, with respect to the transparent image forming surface of the recording material S, compared with the case where the recording material S is always passed through the two fixing devices, it is possible to prevent application of excessive heat quantity to the recording material S. As a result, with respect to the transparent image forming surface of the recording material S, it becomes possible to suppress the occurrences of inconveniences such as the hot offset and the improper separation.

Further, depending on the image forming mode, it becomes possible to reduce the heat quantity difference between the first surface and the second surface during the both side image formation and it also becomes possible to eliminate the glossiness difference between the first surface and the second surface even in the case where the transparent image is formed.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 195194/2010 filed Aug. 31, 2010, which is hereby incorporated by reference.

What is claimed is:

1. An image forming system comprising:

a color image forming apparatus including a color image forming portion for forming a color toner image on a surface of a recording material; a first fixing device including a first fixing member for fixing the color toner image on the surface of the recording material by heating, at a first fixing portion, the surface of the recording material on which the color toner image is formed immediately before by the color image forming portion; a second fixing device including a second fixing member for heating, at a second fixing portion, the surface of the recording material heated immediately before by the first fixing member; and a switching mechanism for switching a conveyance direction of the recording material passing through the first fixing portion to a direction toward the second fixing portion or to a bypass direction of the second fixing portion;

a transparent image forming apparatus including a transparent image forming portion capable of forming a transparent toner image on the surface of the recording material on which the color toner image is fixed by said color image forming apparatus; and a third fixing device including a third fixing member for fixing the transparent toner image on the surface of the recording material by heating, at a third fixing portion, the surface of the recording material on which the transparent toner image is formed immediately before by the transparent image forming portion; and a controller for controlling the switching mechanism so that the conveyance direction of the recording material is, when the surface of the recording material, on which the color toner image is formed immediately before by the color image forming portion, is to be subjected to formation of the transparent toner image by said transparent image forming apparatus, switched to the bypass direction of the second fixing portion, and so that the conveyance direction of the recording material is, when the surface of the recording material, on which the color toner image is formed immediately before by the color image forming portion, is to be not subjected to formation of the transparent toner image by said transparent image forming apparatus, switched to the direction toward the second fixing portion.

2. A system according to claim 1, wherein said color image forming apparatus includes a first both side mechanism for conveying the recording material, on which the color toner image is fixed to one surface, to the color toner image forming portion where the color toner image is to be formed on the recording material at the other surface, wherein said transparent image forming apparatus includes a second both side mechanism for conveying the recording material, on which the transparent toner image is fixed to the one surface, to the transparent toner image forming portion where the transparent toner image is to be formed on the recording material at the other surface, and wherein said controller controls the switching mechanism so that:

(a) in the case where the color toner image is formed on the recording material at both surfaces by said color image forming apparatus and then the transparent toner image is formed on the recording material at both surfaces by said transparent image forming apparatus, the switching mechanism switches the conveyance direction of the recording material to the bypass direction of the second fixing portion even when the surface of the recording material on which the color toner image is formed immediately before by said color image forming apparatus is either one of the one surface and the other surface, (b) in the case where the color toner image is formed on the recording material at both surfaces by said color image forming apparatus and then the transparent toner image is formed on the recording material at the one surface by said transparent image forming apparatus, the switching mechanism switches the conveyance direction of the recording material to the bypass direction of the second fixing portion when the surface of the recording material on which the color toner image is formed immediately before by said color image forming apparatus is the one surface on which the transparent toner image is formed, and switches the conveyance direction of the recording material to the bypass direction toward the second fixing portion when the surface of the recording material on which the color toner image is formed immediately before by said color image forming apparatus is the other surface on which the transparent toner image is not formed, and (c) in the case where the color toner image is formed on the recording material at both surfaces by said color image forming apparatus but the transparent toner image is not formed on the recording material at both surfaces by said transparent image forming apparatus, the switching mechanism switches the conveyance direction of the recording material to the bypass direction toward the second fixing portion even when the surface of the recording material on which the color toner image is formed immediately before by said color image forming apparatus is either one of the one surface and the other surface.

3. A system according to claim 1, wherein said transparent image forming apparatus includes a circumventing mechanism for discharging therefrom the recording material, on which the color toner image is fixed on at least one of one surface and the other surface by said color image forming apparatus, by causing the recording material to circumvent the transparent toner image forming portion where the transparent toner image is to be formed on the recording material by said transparent image forming apparatus and to circumvent the third fixing portion.

* * * * *